US009839268B2

(12) United States Patent
Chen et al.

(10) Patent No.: US 9,839,268 B2
(45) Date of Patent: Dec. 12, 2017

(54) WIND-RESISTANT UMBRELLA FRAME STRUCTURE

(71) Applicant: Xiamen Mingho Brothers MFG Co., Ltd., Xiamen (CN)

(72) Inventors: Tien-Cheng Chen, Xiamen (CN); Sun-Feng Sung, Xiamen (CN)

(73) Assignee: XIAMEN MINGHO BROTHERS MFG CO., LTD., Xiamen, Fujian (CN)

( * ) Notice: Subject to any disclaimer, the term of this patent is extended or adjusted under 35 U.S.C. 154(b) by 0 days.

(21) Appl. No.: 15/260,280

(22) Filed: Sep. 8, 2016

(65) Prior Publication Data

US 2017/0215535 A1 Aug. 3, 2017

(30) Foreign Application Priority Data

Feb. 1, 2016 (CN) ..... 2016 2 0098350 U

(51) Int. Cl.
*A45B 25/22* (2006.01)
*A45B 25/02* (2006.01)

(52) U.S. Cl.
CPC ..... *A45B 25/22* (2013.01); *A45B 25/02* (2013.01); *A45B 2200/1036* (2013.01)

(58) Field of Classification Search
CPC .. A45B 25/22; A45B 25/02; A45B 2200/1036
See application file for complete search history.

(56) References Cited

U.S. PATENT DOCUMENTS 5,063,953 A * 11/1991 Wu ..... A45B 19/10 135/25.3
6,058,952 A * 5/2000 Lin ..... A45B 25/22 135/23
6,186,157 B1 * 2/2001 Lin ..... A45B 25/22 135/25.1
6,296,001 B1 * 10/2001 Lin ..... A45B 19/10 135/25.1
6,736,151 B2 * 5/2004 Lin ..... A45B 25/22 135/22
7,415,986 B2 * 8/2008 Wu ..... A45B 25/22 135/31
2007/0017562 A1 * 1/2007 Ko ..... A45B 25/22 135/25.3
2015/0096601 A1 * 4/2015 Haythornthwaite ... A45B 25/22 135/22

FOREIGN PATENT DOCUMENTS

FR 2673082 B3 * 1/1993 ..... A45B 19/10

* cited by examiner

*Primary Examiner* — Noah Chandler Hawk
(74) *Attorney, Agent, or Firm* — Leong C. Lei

(57) ABSTRACT

A wind-resistant umbrella frame structure is applicable to an arrangement of dual canopies and includes a primary frame and a secondary frame. The primary frame has an inner end pivotally connected to a crown and an outer end connected to the annular lower canopy. The secondary frame is pivotally connected to the runner and has an opposite end pivotally connected to the primary frame. The primary frame includes an internal rib, an intermediate rib, an external rib, and a traction rib assembly, and also includes an intermediate rib return wire, an external rib return wire, and a collapse spring. The umbrella frame structure allows air flows to be readily conducted out and ensures the service life of the canopies.

3 Claims, 2 Drawing Sheets

WIND-RESISTANT UMBRELLA FRAME STRUCTURE

(a) TECHNICAL FIELD OF THE INVENTION

The present invention relates generally to an umbrella, and more particularly to a wind-resistant umbrella frame structure.

(b) DESCRIPTION OF THE PRIOR ART

Umbrellas are commonly used in everyday living for not only sheltering rain, but also providing functions of sunlight shading and wind shielding. One common problem that the general public may encounter in using umbrellas is that strong winds or gusts may blow the umbrella inside out in a windy raining day. This makes the user feel insecure. This situation is particularly true for multi-folded umbrella ribs for the umbrella ribs are made up of multiple sections pivoted to each other and such a situation may readily occur in the pivot joints. Umbrellas undergo such a situation may get readily damaged. In addition, it is quite inconvenient that the umbrella ribs of an inside-out umbrella must be turned one by one back to the original shape before the umbrella can be converted back to the original configuration.

In view of this, a wind-resistant umbrella with dual layers of umbrella cloth is available. Such dual layers of umbrella cloth comprises an annular canopy that is located at a lower side and a small canopy that is stacked above the annular canopy so that winds that move into the space below the umbrella may pass through the annular canopy and thus move out through a gap present between the annular canopy and the small canopy that are stacked on each other thereby achieving an effect of resisting or withstanding winds and gusts and preventing the umbrella from being turned inside out due to the umbrella configuration that collects winds on the underside thereof in a windy day of strong winds or gusts. However, the known wind-resisting umbrellas suffer canopy slackening or collapsing and closing umbrella being unsmooth. Thus, it is desired to further improve the umbrella frames.

SUMMARY OF THE INVENTION

An object of the present invention is to provide a wind-resistant umbrella frame structure, which helps ensure a canopy maintaining normal functioning for use in a windy day and provides effects of simple structure, reliable function, and stable performance.

To achieve the above object, the present invention provides a solution as follows:

A wind-resistant umbrella frame structure is applicable to an arrangement of dual canopies. The umbrella frame structure comprises a primary frame and a secondary frame, wherein the primary frame has an inner end pivotally connected to an umbrella crown and an outer end connected, through a bead, to an outer circumference of an annular lower canopy. The secondary frame has an end pivotally connected to a runner that is slidable up and down along an umbrella post and an opposite end pivotally connected to the primary frame. The primary frame comprises an internal rib, an intermediate rib, an external rib, and a traction rib assembly and also comprises an intermediate rib return wire, an external rib return wire, and a collapse spring. The internal rib has an inner end pivotally connected to the crown and an outer end pivotally connected, through a first pivot joint, to the intermediate rib and the intermediate rib has an outer end pivotally connected, through a second pivot joint, to the external rib. The intermediate rib return wire has an end pivotally connected to the secondary frame and an opposite end pivotally connected to the first pivot joint and the collapse spring has an end connected to the secondary frame and an opposite end connected to the first pivot joint. The external rib return wire has an end pivotally connected to the intermediate rib and an opposite end pivotally connected to the external rib. The traction rib assembly has an end connected to the first pivot joint and an opposite end connected to the external rib.

The intermediate rib return wire has an end pivotally connected to the secondary frame and an opposite end pivotally connected to a joint of the first pivot joint on the intermediate rib.

The traction rib assembly comprises a rigid traction rib and a flexible traction wire. The traction rib has a free end connected to the first pivot joint. The traction wire has a free end connected to the external rib at a location adjacent to an outer end thereof.

The annular lower canopy has an inner circumference fixed to the first pivot joint.

An upper canopy has an outer circumference fixed to an outside surface of the annular lower canopy at a location corresponding to the frame and the fixed end is close, in location, to the second pivot joint. The first pivot joint forms a connection point with the upper canopy.

Adopting the above solution allows the wind-resistant umbrella frame according to the present invention to provide effectively improved supporting to the upper canopy and also providing advantages of simplified structure and stable supporting and also allowing airflows to be readily conducted out and ensuring service life of the canopies.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
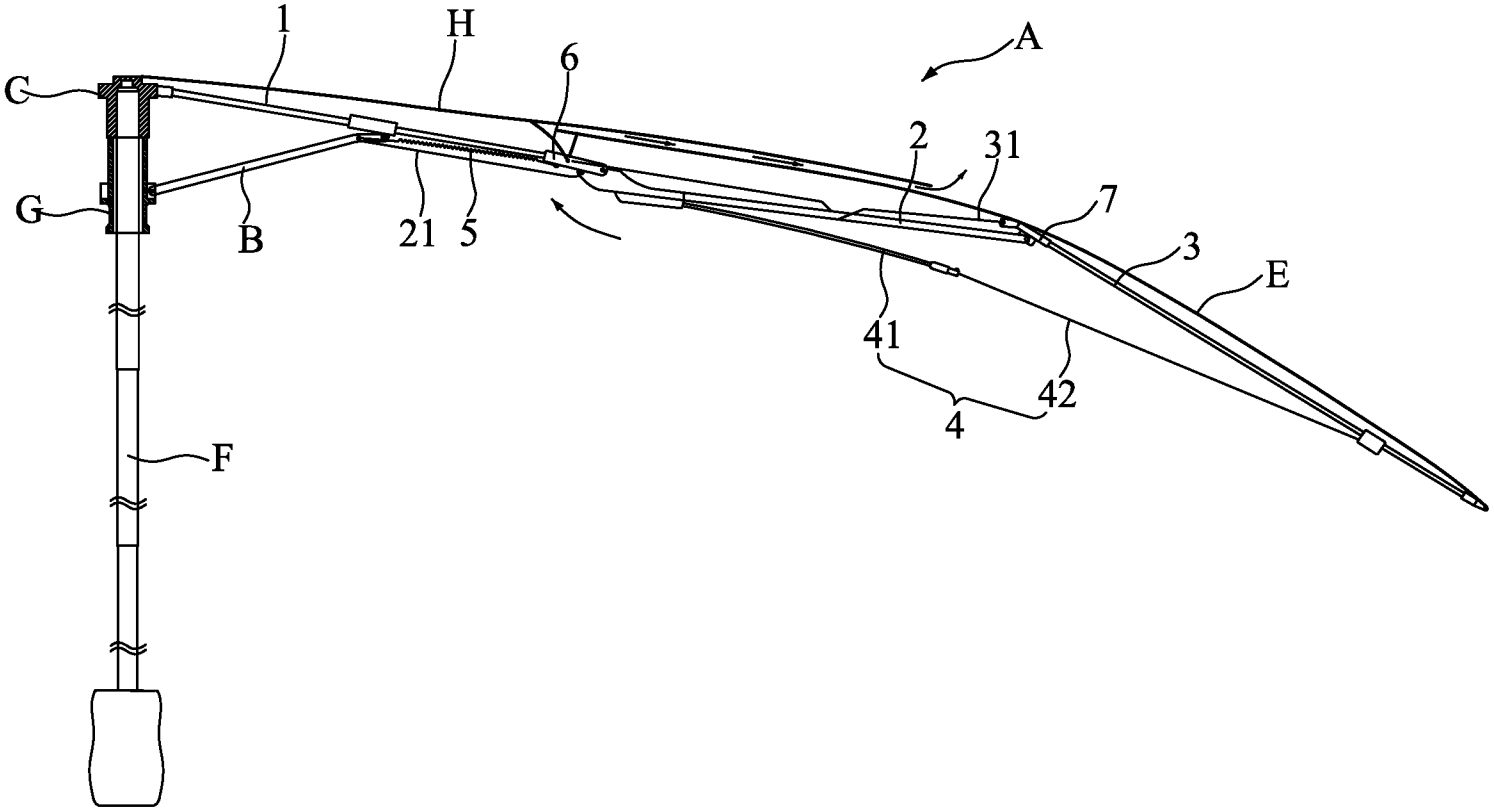
FIG. 1 is a schematic view showing a wind-resistant umbrella according to the present invention.
Figure 2:
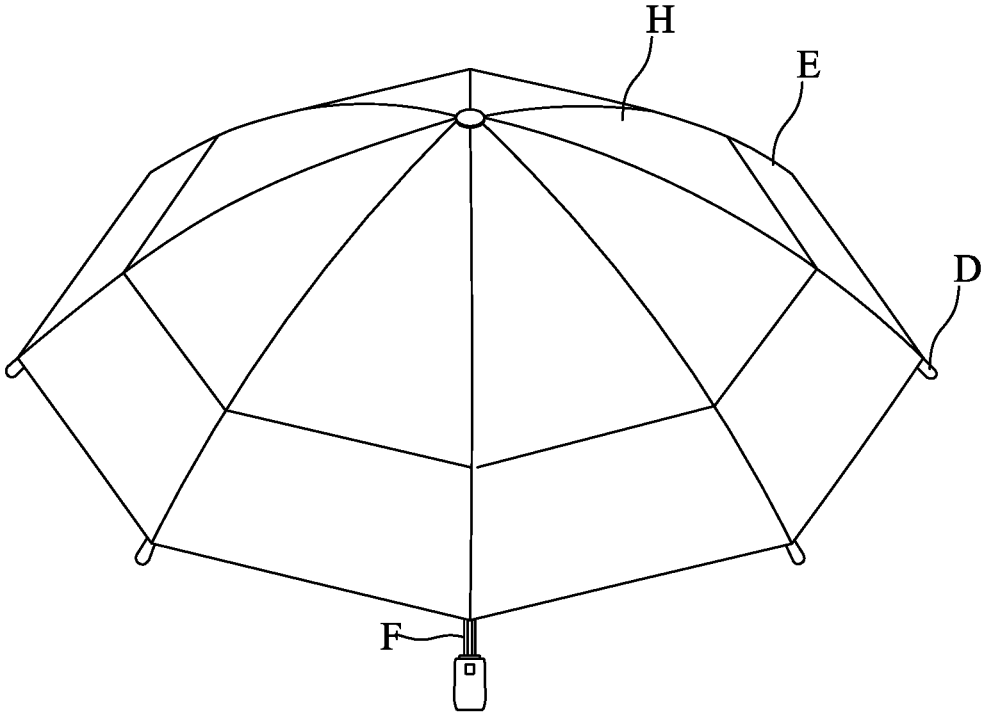
FIG. 2 is a schematic view illustrating an umbrella frame structure according to the present invention.

As shown in FIGS. 1 and 2, the present invention discloses a wind-resistant umbrella frame structure, which is applicable to a dual-canopy arrangement. The umbrella frame structure comprises a primary frame A and a secondary frame B, wherein the primary frame A has an inner end pivotally connected to an umbrella crown C and an outer end connected, through a bead D, to an outer circumference of an annular lower canopy E. The secondary frame B has an end pivotally connected to a runner G that is slidable up and down along an umbrella post F and an opposite end pivotally connected to the primary frame A.

The primary frame A comprises an internal rib 1, an intermediate rib 2, an external rib 3 and a traction rib assembly 4 and also comprises an intermediate rib return wire 21, an external rib return wire 31, and a collapse spring 5. The internal rib 1 has an inner end pivotally connected to the crown C and an outer end that is pivotally connected to the intermediate rib 2 at a first pivot joint 6. The intermediate rib 2 has an outer end pivotally connected to the external rib 3 at a second pivot joint 7. The intermediate rib return wire 21 has an end pivotally connected to the secondary frame B and an opposite end pivotally connected to a joint of the first pivot joint 6 on the intermediate rib 2. The collapse spring 5 has an end connected to the secondary frame B and an opposite end connected to the first pivot joint 6. The external rib return wire 31 has an end connected to the first pivot joint 6 and an opposite end pivotally connected to the external rib 3. The traction rib assembly 4 comprises a rigid traction rib 41 and a flexible traction wire 42 coupled to each other. The traction rib 41 has a free end connected to the intermediate rib 2 and the traction wire 42 has a free end connected to the external rib 3 at a location adjacent to an outer end thereof.

The secondary frame B has an opposite end pivotally connected to the internal rib 1.

The annular lower canopy E has an inner circumference that is fixed to the first pivot joint 6.

An upper canopy H has an outer circumference that is fixed to an outside surface of the annular lower canopy E at a location corresponding to the frame and the fixed end is close, in location, to the second pivot joint. The first pivot joint 6 also forms a connection point with the upper canopy E.

When the canopies are expanded, said opposite end of the secondary frame B pushes the internal rib 1 to expand by following an upward movement of the runner G and at the same time, the intermediate rib return wire 21 applies a force to the joint of the first pivot joint 6 on the intermediate rib 2 in a direction toward the umbrella post so as to allow the external rib 3 to be expanded during expansion of the intermediate rib 2, whereby through such a series of movements of the frame, an operation of opening the umbrella is achieved and the collapse spring 5 is in a condition of being stretched with energy stored therein. The arrangement of the traction rib assembly 4 provides a predetermined force of traction to the external rib 3 to prevent the frame from being turned inside out due to the canopy receiving and collecting winds therein.

When a gust or strong wind is encountered, an air flow blows in from the underside of the canopies and an air flow passage is formed between the upper canopy H and the annular lower canopy E to smoothly conduct the air flow out whereby a situation that the frame is turned inside out or even broken in a windy day could be prevented.

To collapse the umbrella, due to the spring force of the collapse spring 5, together with a downward movement of the runner the ribs are moved opposite to the umbrella opening operation as described above so as to achieve an effect of closing the umbrella.

In summary, the present invention provides a wind-resistant umbrella frame that helps effectively improve supporting to an upper canopy H and also provides advantages of simplified structure and stable supporting and allowing air flow to be readily conducted out to ensure the service life of the umbrella canopy.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

We claim:

1. A wind-resistant umbrella frame structure, which is applicable to an arrangement of dual canopies including an upper canopy and an annular lower canopy, the umbrella frame structure comprising a primary frame and a secondary frame, wherein the primary frame has an inner end pivotally connected to an umbrella crown and an outer end connected, through a bead, to an outer circumference of the annular lower canopy; and the secondary frame has an end pivotally connected to a runner that is slidable up and down along an umbrella post and an opposite end pivotally connected to the primary frame; wherein the primary frame comprises an internal rib, an intermediate rib, an external rib, and a traction rib assembly and also comprises an intermediate rib return wire, an external rib return wire, and a collapse spring; the internal rib has an inner end pivotally connected to the crown and an outer end pivotally connected, through a first pivot joint, to an inner end of the intermediate rib and the intermediate rib has an outer end pivotally connected, through a second pivot joint, to an inner end of the external rib and the external rib has an outer end serving as the outer end of the primary frame and connected to the outer circumference of the annular lower canopy; the intermediate rib return wire has an end pivotally connected to the secondary frame and an opposite end pivotally connected to the first pivot joint and the collapse spring has an end connected to the secondary frame and an opposite end connected to the first pivot joint; the external rib return wire has an end pivotally connected to the intermediate rib and an opposite end pivotally connected to the external rib; and the traction rib assembly has an inner end connected to the first pivot joint and an opposite, outer end connected to the external rib, wherein the annular lower canopy has an inner circumference fixed to the first pivot joint; and the upper canopy is attached to the umbrella crown and has an outer circumference fixed at a location close to the second pivot joint, wherein a portion of the upper canopy that is located between the umbrella crown and the outer circumference thereof is connected to the first pivot joint such that the portion of the upper canopy and the inner circumference of the annular lower canopy are both attached to the first pivot joint to which the inner end of the traction rib assembly is connected.

2. The wind-resistant umbrella frame structure according to claim 1, wherein the intermediate rib return wire has an end pivotally connected to the secondary frame and an opposite end pivotally connected to a joint of the first pivot joint on the intermediate rib.

3. The wind-resistant umbrella frame structure according to claim 1, wherein the traction rib assembly comprises a rigid traction rib and a flexible traction wire, the rigid traction rib having a free end serving as the inner end of the traction rib assembly and connected to the first pivot joint, the traction wire having a free end serving as the opposite outer end of the traction rib assembly and connected to the external rib at a location adjacent to an outer end thereof.

* * * * *